US008466765B2

(12) United States Patent
Markowski et al.

(10) Patent No.: US 8,466,765 B2
(45) Date of Patent: Jun. 18, 2013

(54) CORE AND COIL CONSTRUCTION FOR MULTI-WINDING MAGNETIC STRUCTURES

(75) Inventors: Piotr Markowski, Ansonia, CT (US); Lin Guo Wang, Nanjing (CN); Hong Fei Bu, Nanjing (CN); Feng Chuan Gao, Nanjing (CN); Jian Wang, Nanjing (CN)

(73) Assignee: Astec International Limited, Kwun Tong, Kowloon (HK)

( * ) Notice: Subject to any disclaimer, the term of this patent is extended or adjusted under 35 U.S.C. 154(b) by 47 days.

(21) Appl. No.: 13/094,318

(22) Filed: Apr. 26, 2011

(65) Prior Publication Data

US 2012/0098632 A1 Apr. 26, 2012

Related U.S. Application Data

(63) Continuation of application No. 13/125,676, filed as application No. PCT/CN2010/077898 on Oct. 20, 2010.

(51) Int. Cl.
*H01F 17/04* (2006.01)

(52) U.S. Cl.
USPC ..... 336/170

(58) Field of Classification Search
USPC ..... 336/65, 83, 192, 200, 212, 232–234, 336/170
See application file for complete search history.

(56) References Cited

U.S. PATENT DOCUMENTS

| | | | | |
|---|---|---|---|---|
| 3,246,273 | A * | 4/1966 | Reade | 336/219 |
| 3,684,991 | A * | 8/1972 | Trump et al. | 336/70 |
| 5,587,694 | A * | 12/1996 | Minato et al. | 336/65 |
| 6,060,977 | A | 5/2000 | Yamamoto et al. | |
| 7,352,269 | B2 | 4/2008 | Li et al. | |
| 7,498,920 | B2 | 3/2009 | Sullivan et al. | |
| 7,525,408 | B1 | 4/2009 | Li et al. | |
| 7,782,168 | B2 * | 8/2010 | Nakatsu et al. | 336/221 |
| 2009/0179723 | A1 * | 7/2009 | Ikriannikov et al. | 336/200 |

FOREIGN PATENT DOCUMENTS

| | | |
|---|---|---|
| CN | 101453166 | 6/2009 |
| CN | 101661832 | 3/2010 |
| JP | 2010-171357 | 8/2010 |
| WO | 2009/114872 | 9/2009 |

OTHER PUBLICATIONS

"Principles of Power Electronics"; J. Kassakain, M. Sclecht and G. Verghese; 1991; p. 600.

* cited by examiner

*Primary Examiner* — Tuyen Nguyen
(74) *Attorney, Agent, or Firm* — Harness, Dickey & Pierce, P.L.C.

(57) ABSTRACT

Multi-winding magnetic structures and methods of making multi-winding magnetic structures are disclosed. In one embodiment, a multi-winding magnetic structure includes a core constructed of a magnetic material and a plurality of windings. The core includes a core top, a core bottom, and a plurality of columns. The core top has an exterior edge defining a shape of the core top. A central section of the core top has a substantially constant thickness that defines a thickness of the core top. The core bottom is beneath the core top and has an exterior edge defining a shape of the core bottom. A central section of the core bottom has a substantially constant thickness that defines a thickness of the core bottom. The thickness of one of the core bottom and the core top decreases from an edge of its central section to its exterior edge. The plurality of columns extends from the core bottom to the core top and the plurality of windings are wound around the columns.

21 Claims, 12 Drawing Sheets

CORE AND COIL CONSTRUCTION FOR MULTI-WINDING MAGNETIC STRUCTURES

CROSS-REFERENCE TO RELATED APPLICATIONS

This application is a continuation of U.S. application Ser. No. 13/125,676, filed Apr. 22, 2011, and claims priority to PCT Application No. PCT/CN2010/077898 filed Oct. 20, 2010. The entire disclosures of the above applications are incorporated herein by reference.

FIELD

The present disclosure relates to multi-winding magnetic structures.

BACKGROUND

This section provides background information related to the present disclosure which is not necessarily prior art.

A transformer is a device that transfers electrical energy from one circuit to another through inductively coupled conductors. The inductively coupled conductors are the transformer's coils or windings.

In one form, a transformer has two galvanically separated coils. These coils are commonly referred to as a primary winding and a secondary winding. Designation as the primary winding is usually given to the winding that is galvanically connected to a source of energy or circuitry actively controlling electrical parameters. The secondary winding is typically the winding that is connected to a receiver of energy or a circuit passively responding to the actions of the primary circuitry. Of course, primary/secondary designations are typically not meaningful with respect to the transformer itself and are descriptive only for the role this transformer performs in the overall circuit. Primary and secondary windings work the same way as to the main principles of transformers. With a transformer with identical primary and secondary coils, for example, the coils can be interchanged without any impact on the operation of a circuit (or circuits) connected to such transformer. Interchanging the coils of a transformer having different primary and secondary coils would change voltage and current relationships, but would impact connected circuitry only, while the transformer itself would work the same way. Furthermore, the primary and secondary windings may be connected, used, etc. in ways other than common transformers, rendering the primary and secondary terminology meaningless (and possibly confusing). Terminology becomes even more confusing with transformers having multiple windings, including, for example, magnetic structures as disclosed in the present application. Therefore, numerical designations for various windings (instead of primary-secondary) will typically be used herein.

FIG. 1 illustrate a two winding transformer, generally indicated by the reference numeral 100, along with the voltages V1, V2 across the windings of the transformer 100 and the currents I1, I2 through the windings of the transformer 100. To improve energy transfer between windings, a highly magnetic (high permeability) material is commonly used as a transformer core 102. This core 102 provides a low reluctance path for the magnetic field, passing through both windings, such that nearly all of the magnetic field is enclosed by the first and second coils. The relationship between voltages and currents in a two winding transformer (e.g., transformer 100) are determined by the ratio of the number of turns N1 of the first winding to the number of turns N2 of the second winding (i.e., the turns ratio). The relationship may be expressed mathematically as $$\frac{V1}{V2} = \frac{-I2}{I1} = \frac{N1}{N2} \tag{1}$$

An example of a transformer 200 with more than two windings is shown in FIG. 2. Such transformers are commonly used in utility line frequency applications (50/60 Hz), and in high frequency switched mode power supplies. The transformer 200 includes a first, a second and a third winding having N1, N2 and N3 turns respectively. The voltages across the first, second and third windings are V1, V2 and V3, respectively, and the currents entering the first, second and third windings are I1, I2 and I3, respectively. The transformer 200 is commonly called a series multi-winding transformer.

The relationship between voltages and currents for transformer 200 (and for other transformers having more than two windings) differs from the relationship between voltages and currents for two winding transformer (e.g., transformer 100). The voltages across all three windings of transformer 200 are related by the turns ratios in the same manner as a two winding transformer (e.g., transformer 100). Namely, the voltage relationships are governed by the equation:

$$\frac{V1}{N1} = \frac{V2}{N2} = \frac{V3}{N3} \tag{2}$$

However, the current relationship for a two winding transformer (e.g., 100) expressed in equation (1) is not valid in the case of transformer 200. Knowing the current of one of the windings and the turns ratios does not allow determination of the current of the other windings. Instead, the sum of ampere-turn products of all windings must be equal to zero. Mathematically this rule is expressed as:

$$\sum_{k=1}^{n} Ik * Nk = 0 \tag{3}$$

A parallel multi-winding transformer 300 is shown in FIG. 3. The transformer 300 includes a first, a second and a third winding having N1, N2 and N3 turns, respectively. The voltages across the first, second and third windings are V1, V2 and V3, respectively, and the currents at the beginning of the first, second and third windings are I1, I2 and I3, respectively.

Parallel multi-winding transformer 300 is characterized by a deterministic current relationship between any two windings:

$$I1*N1=I2*N2=I3*N3 \tag{4}$$

However, the law for the voltages for parallel multi-winding transformer 300 reflects a weaker interrelationship given by:

$$\sum_{k=1}^{n} \frac{Vk}{Nk} = 0 \tag{5}$$

Transformer 300 may be used for power sources where output current is controlled (rather than output voltage) or where equal current distribution in multiple branches of the circuit is desired for more accurate operation or stress reduction.

The relationships presented above, e.g., equations (2)-(5), demonstrate the difference between series multi-winding transformers and parallel multi-winding transformers. These relationships do not include the effect of various non-ideal properties of the transformers, as the non-ideal properties are generally irrelevant for illustration of the differences between these two structures One non-ideal property of transformers that is important in some applications, including, for example, high frequency applications, is leakage inductance. Leakage inductance represents energy stored in the magnetic field that is not coupled between various windings. Leakage inductance manifests itself as if an uncoupled inductor was placed in series with the transformer winding. This inductor creates additional impedance, which may interfere with the operation of the circuit.

Various techniques for constructing transformers with low leakage inductance are known. These known techniques are commonly based on physical arrangement of the core and the windings with different windings placed as close to one to another as possible. Two of the techniques for constructing transformers with low leakage inductance are interleaving and multifilar winding. In interleaving, windings are divided into multiple sections arranged in alternate layers. In multifilar winding, more than one winding is wound on a core using isolated multistrand wires.

These known techniques for constructing low leakage inductance transformers, however, are typically applicable only to series multi-winding transformers, as the techniques require different windings to be placed physically on the same part of a core. This kind of physical proximity generally may not be used for a parallel multi-winding transformer, as it is not compatible with its structure.

SUMMARY

This section provides a general summary of the disclosure, and is not a comprehensive disclosure of its full scope or all of its features.

According to one aspect of this disclosure, a multi-winding magnetic structure includes a magnetic core including a first column and a second column. The first column and the second column are spaced apart from each other to define a winding window between the first column and the second column. The magnetic core includes a core top overlying the first and second columns and defining a top of the winding window, and a core bottom underlying the first and second columns and defining a bottom of the winding window. The magnetic structure includes a first winding positioned around the first column and a second winding positioned around the second column. The first winding includes a plurality of turns of winding material passing through the winding window. The second winding includes a plurality of turns of winding material passing through the winding window. The first winding and the second winding extend in a same direction around the first and second column. The plurality of turns of the first winding alternate with the plurality of turns of the second winding in the winding window in a direction from the core top to the core bottom.

According to another aspect, a multi-winding magnetic structure includes a magnetic core including a first column, a second column, and a third column. Each of the first, second and third columns has a center, the first and second columns are spaced apart from each other to define a first winding window between the first and second column. The third column is spaced apart from one of the first and second columns to define a second winding window between the third column and said one of the first and second columns. The first, second and third columns are positioned relative to each other such that a single straight line would not pass through the center of all three columns. The magnetic core includes a core top overlying the first, second and third columns and defining a top of the first and second winding windows and a core bottom underlying the first, second and third columns and defining a bottom of the first and second winding window. The magnetic structure includes a first winding positioned around the first column, a second winding positioned around the second column, and a third winding positioned around the third column.

In yet another aspect of this disclosure, a multi-winding magnetic structure includes a magnetic core including a core top having an exterior edge and a core bottom beneath the core top. A central section of the core top has a substantially constant thickness. The core bottom has an exterior edge. A central section of the core bottom has a substantially constant thickness and an edge. The thickness of one of the core bottom and the core top decreases from the edge of its central section to its exterior edge. The magnetic core includes a plurality of columns extending between the core bottom and the core top. The magnetic structure includes a plurality of windings wound around the columns.

In another aspect of this disclosure, a multi-winding magnetic structure includes a magnetic core including a first column having a width and a second column having a width. The second column is positioned spaced from the first column. The magnetic core includes a winding window between the first and second columns and having a width defined by the first and second columns. A first ratio of the width of the first column to the width of the winding window is at least two and a second ratio of the width of the second column to the width of the winding window is at least two. The magnetic structure includes a first winding around the first column passing through the winding window and a second winding around the second column and passing through the winding window.

Some example embodiments of magnetic structures incorporating one of more of these aspects are described below. Additional aspects and areas of applicability will become apparent from the description below. It should be understood that various aspects of this disclosure may be implemented individually or in combination with one or more other aspects. It should also be understood that the description and specific examples herein are provided for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
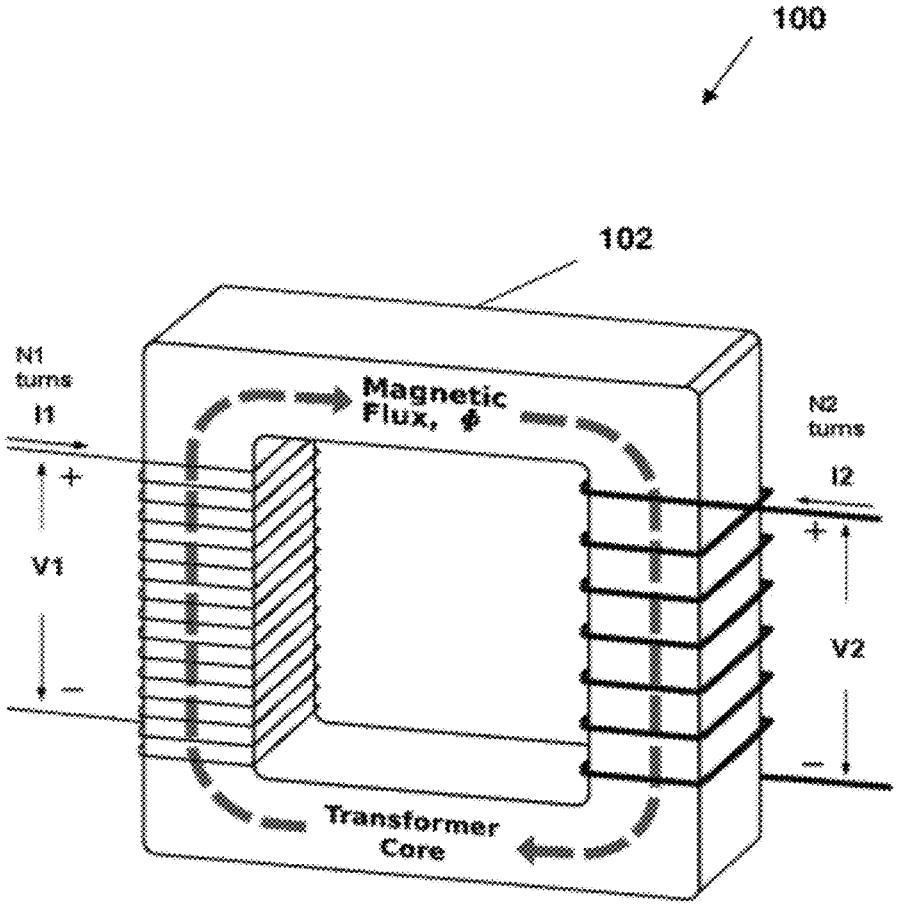
Fig. 1 (Prior Art)
FIG. 1 is an isometric view of a prior art two winding transformer.
Figure 2:
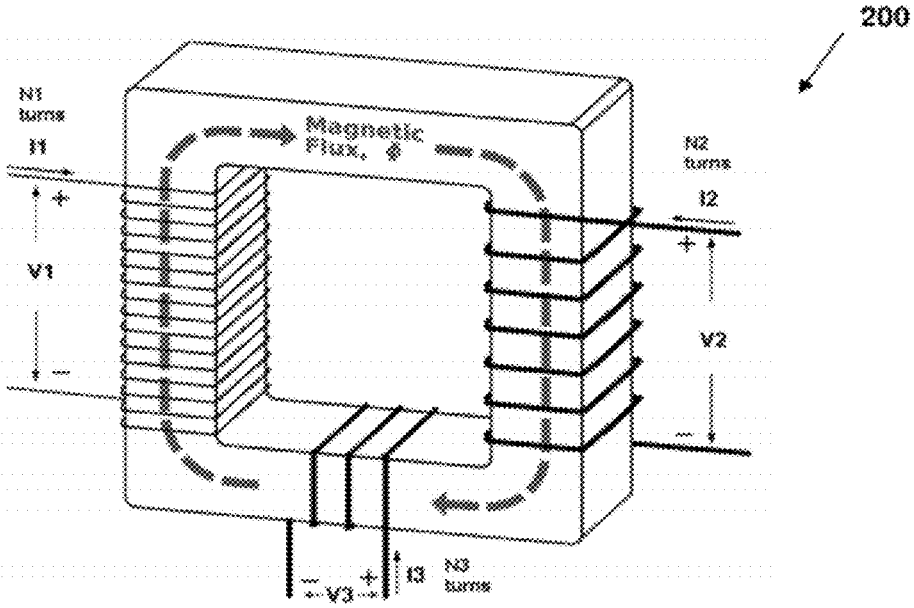
Fig. 2 (Prior Art)
FIG. 2 is an isometric view of a prior art series multi-winding transformer.
Figure 3:
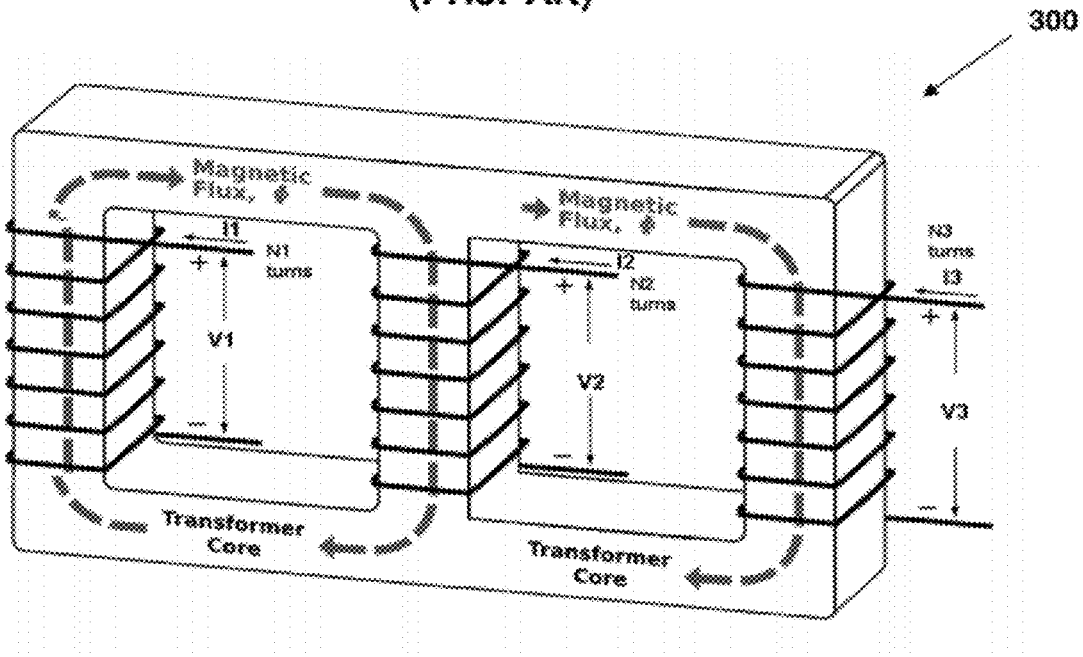
Fig. 3 (Prior Art)
FIG. 3 is an isometric view of a prior art parallel multi-winding transformer.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

This disclosure describes multi-winding parallel magnetic structures and methods for making and designing such structures. The structures and techniques described herein may be used for multi-winding parallel transformers, multi-winding parallel inductors (e.g., non-isolated magnetic structures), chokes (e.g., inductors designed to carry significant DC bias) and autotransformers (e.g., transformers changing current/voltage relationship via inductive coupling without providing isolation). In this disclosure, the term multi-winding parallel magnetic structure will be used to cover any or all these structures. The techniques disclosed herein may be used individually or in any combination to produce a desired parallel multi-winding magnetic structure.

Low leakage inductance in a parallel multi-winding magnetic structure can be achieved by reducing the amount of energy stored in the part of the magnetic field that is associated with only one winding. This may be achieved by substantially minimizing the volume of space occupied by the uncoupled field.

According to one aspect of the present disclosure, to reduce the leakage inductance of a parallel multi-winding magnetic structure, the ratio between the area used for the core and that used for the windings is substantially maximized. Examples incorporating this aspect are illustrated in FIGS. 4 and 5.

In embodiments of a parallel multi-winding magnetic structure constructed according to this aspect, the reluctance of the magnetic path through the core may be much lower than if the ratio were not maximized. The fields that exist in the core will tend to flow mostly through other parts of the core and will be coupled to other coils. In a standard transformer, the areas of the core and the winding are approximately equal and optimized such that the sum of core losses and winding losses is minimal. In embodiments of a parallel multi-winding magnetic structure according to this aspect, the ratio between the area of the core and the area of the winding is increased to the point where coupling is sufficient. This may be achieved by designing the parts of the core that provide a magnetic path for individual windings (sometimes called "columns" herein) with a large cross section area, while the space for windings between the columns (sometimes called "windows" or "winding windows" herein) is substantially minimized. In this way the volume of space occupied by the magnetic field that is coupled mostly to one winding window and not another window is minimized.

The width of the core for individual coils is at least two times the width of the winding window in one embodiment. In another embodiment, the ratio of the width of the core and the width of the winding window is at least three. In another embodiment, ratio of the width of the core to the width of the winding window is at least four. The ratio of the width of the core to the width of the winding window is not limited to any of the ratios described herein, and may be any ratio, whether more or less than the ratios expressed herein. Further, the ratio of the core for any one coil to the width of the winding window for that coil may be the same or different than the ratio of the core for any other coil to the width of the winding window for that coil.

Figure 4:
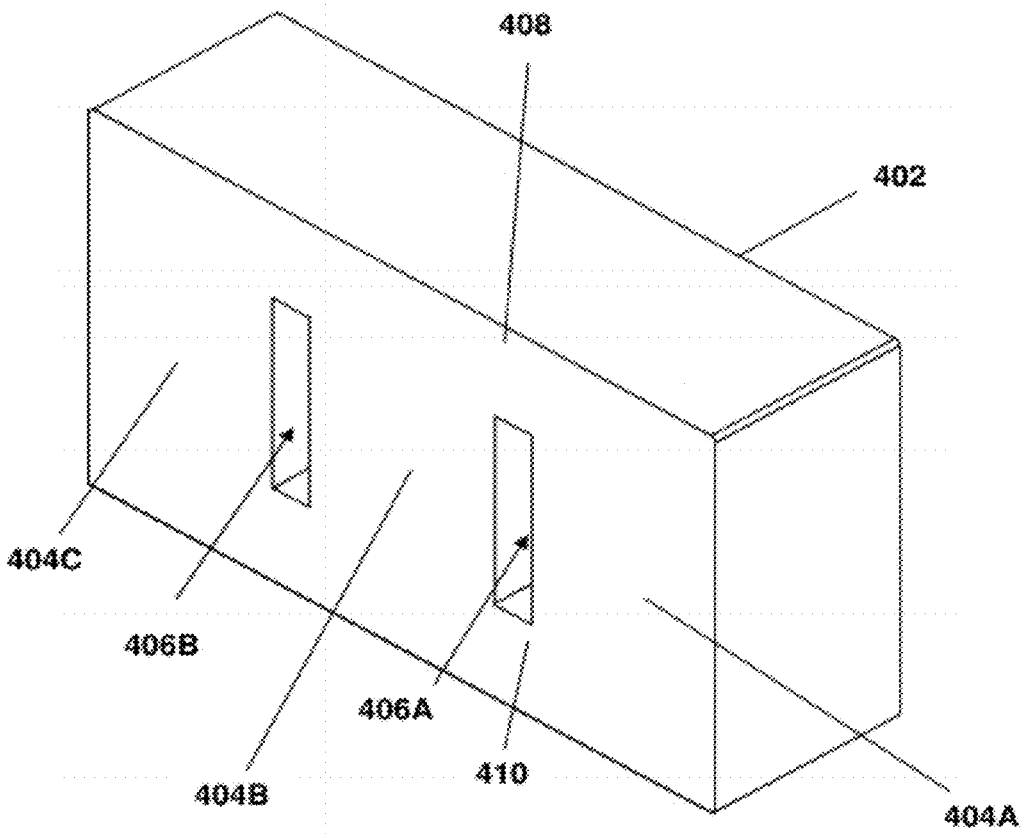
FIG. 4 is an isometric view of an example core for a parallel multi-winding magnetic structure according to an aspect of this disclosure.
Figure 5:
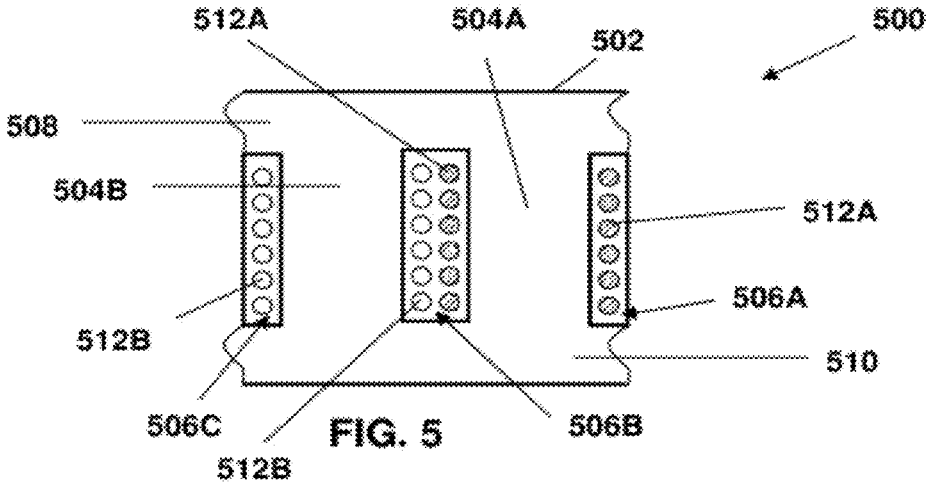
FIG. 5 is a cross sectional slice of a portion of an example parallel multi-winding magnetic structure including the core of FIG. 4

An example core 402 for a parallel multi-winding magnetic structure is illustrated in FIG. 4. The core 402 includes three columns 404A-C (sometimes collectively referred to as columns 404) and two winding windows 406A, 406B (sometimes collectively referred to as winding windows 406). The columns 404 partly define the windows 406. For example, the width of the winding window 406A is defined by the distance between the opposing sides of column 404A and column 404B. Similarly, the width of the winding window 406B is defined by the distance between the opposing sides of column 404B and column 404C.

The core 402 includes a core top 408 and a core bottom 410. The core top 408 overlies the winding columns 404 and defines the top of the winding windows 406. The core bottom 410 underlies the columns 404 and defines the bottom of the winding windows 406. The core top 408 and core bottom 410 may be monolithically formed with the columns 404, may be separately formed parts attached to the columns 404, or a combination of the two (e.g., one of the core top 408 and core bottom 410 may be monolithically formed with the columns 404 and the other of the core top 408 and core bottom 410 may be separately formed and attached to the columns 404). Similarly, the core top 408 and the core bottom 410 may each be a single monolithically formed part, or may be constructed of more than one component, layer, etc.

In core 402 of FIG. 4, the ratio of the width of column 404 to the width of winding window 406 is relatively large. In this example embodiment, the ratio is about four (i.e., the width of each column 404 is about four times the width of each winding window 406).

FIG. 5 illustrates a cross-sectional view of a portion of a parallel multi-winding magnetic structure 500 according to another example embodiment. The structure 500 includes a core 502 and windings 512. The core 502 is similar to the core 402 in FIG. 4, but with differently proportions. The core 502 includes columns 504A, 504B and windows 506A-C. A core top 508 overlies the columns 504 and defines the top of the winding windows 506. The core bottom 510 underlies the columns 504 and defines the bottom of the winding windows 506. Winding 512A is wound around column 504A and passes through winding windows 506A and 506B. Winding 512B is wound around column 504B and passes through winding windows 506B and 506C. In the particular embodiment of FIG. 5, the ratio of the width of the column 504 to the width of the window 506 is about two.

According to another aspect of the present disclosure, the distance between windings of adjacent coils of a parallel multi-winding magnetic structure should be substantially minimized. Placing the windings as close as possible to each other helps reduce leakage inductance of the parallel multi-winding magnetic structure.

According to still another aspect, the distance between a winding and the core (both the column and the core top and core bottom) should be substantially minimized. For example, the height of the winding may cover the height of the core column with a minimum space between the winding and the top and bottom parts of the core.

The latter two aspects may be achieved by keeping the distance between the different windings, and between the windings and the core, only as large as required for proper isolation. Example embodiments incorporating these latter two aspects are illustrated in FIGS. 6 and 7.

Figure 6:
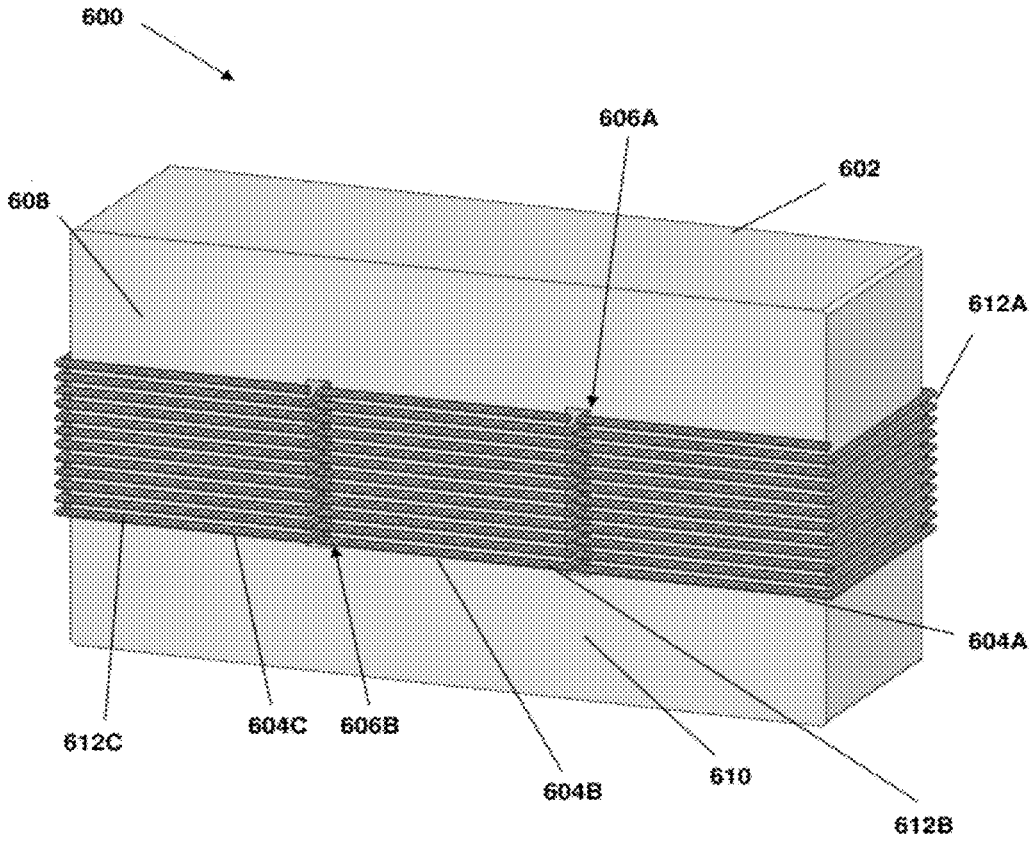
FIG. 6 is an isometric view of an example parallel multi-winding magnetic structure according to various aspects of this disclosure.

One example a parallel multi-winding magnetic structure 600 is illustrated in FIG. 6. The parallel multi-winding magnetic structure 600 includes a core 602 and windings 612A-C. The core includes columns 604A-C, a core top 608 and a core bottom 610. Opposing columns 604, the core top 608 and the core bottom 610 cooperatively define winding windows 606A, 606B (collectively, winding windows 606). For example, opposing columns 604A and 604B cooperatively define, in conjunction with the core top 608 and the core bottom 610, winding window 606A. Likewise, each winding 612A-C is wound around one of the columns 604A-C and passes through at least one winding window 606.

Figure 7:
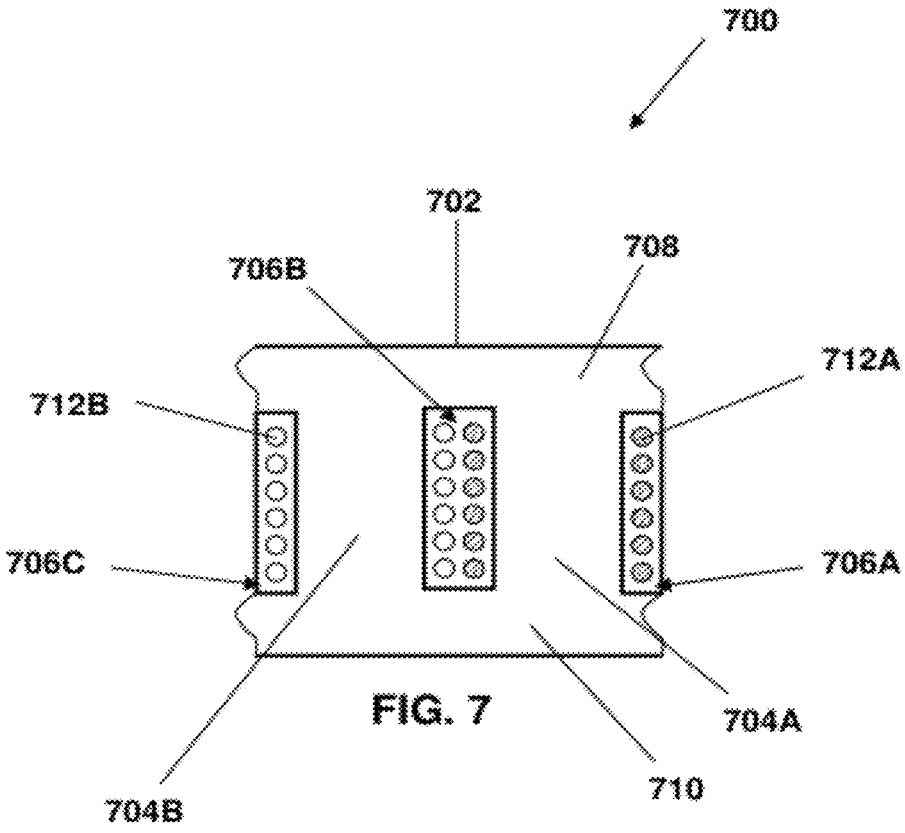
FIG. 7 is a cross sectional slice of a portion of the parallel multi-winding magnetic structure of FIG. 6.

FIG. 7 illustrates a cross-sectional view of a portion of a parallel multi-winding magnetic structure 700 with a core 702 and windings 712 according to another example embodiment. The core 702 is similar to the core 602 in FIG. 6, but has a different number of winding windows (three of which are illustrated). The core 702 includes columns 704A, 704B and winding windows 706A-C. A core top 708 overlies the columns 704 and defines the top of the winding windows 706. The core bottom 710 underlies the columns 704 and defines the bottom of the winding windows 706. Winding 712A is wound around column 704A and passes through winding windows 706A and 706B. Winding 712B is wound around column 704B and passes through winding windows 706B and 706C.

As can be seen in FIGS. 6 and 7, each of the windings 612, 712 of the parallel multi-winding magnetic structures 600, 700 has a substantially minimized distance between adjacent windings 612A/612B, 612B/612C, 712A/712B, and has a substantially minimized distance between the windings 612, 712 and the core 602, 702. The windings 612, 712 occupy substantially all of the height of each winding window 606, 706 through which they pass. Further, different windings (e.g. windings 712A and 712B) passing through a same winding window (e.g., winding window 706B) are close together (i.e., exhibit a substantially minimized distance between the windings 712).

The incorporation of the aforementioned aspects in parallel multi-winding magnetic structures 600, 700 can be clearly seen by contrasting the parallel multi-winding magnetic structures 600, 700 with, for example, transformer 300 in FIG. 4. In transformer 300, the windings are separated from each other by a substantial distance.

According to another aspect of the present disclosure, a parallel multi-winding magnetic structure's windings are wound using an intercoil bifilar technique. This new winding technique may reduce the amount of energy in the uncoupled magnetic field and, therefore, may reduce the leakage inductance of the parallel multi-winding magnetic structure. Adjacent coils with multiple turns have their windings arranged in an alternating way (e.g., from top to bottom of a winding window, from side to side of a winding window, etc.). Using the intercoil bifilar technique, the windings may be alternated in a turn by turn fashion or may be alternated in groups of more than one turn. Various embodiments of parallel multi-winding magnetic structures incorporating this aspect are illustrated in FIGS. 8-11.

Figure 8:
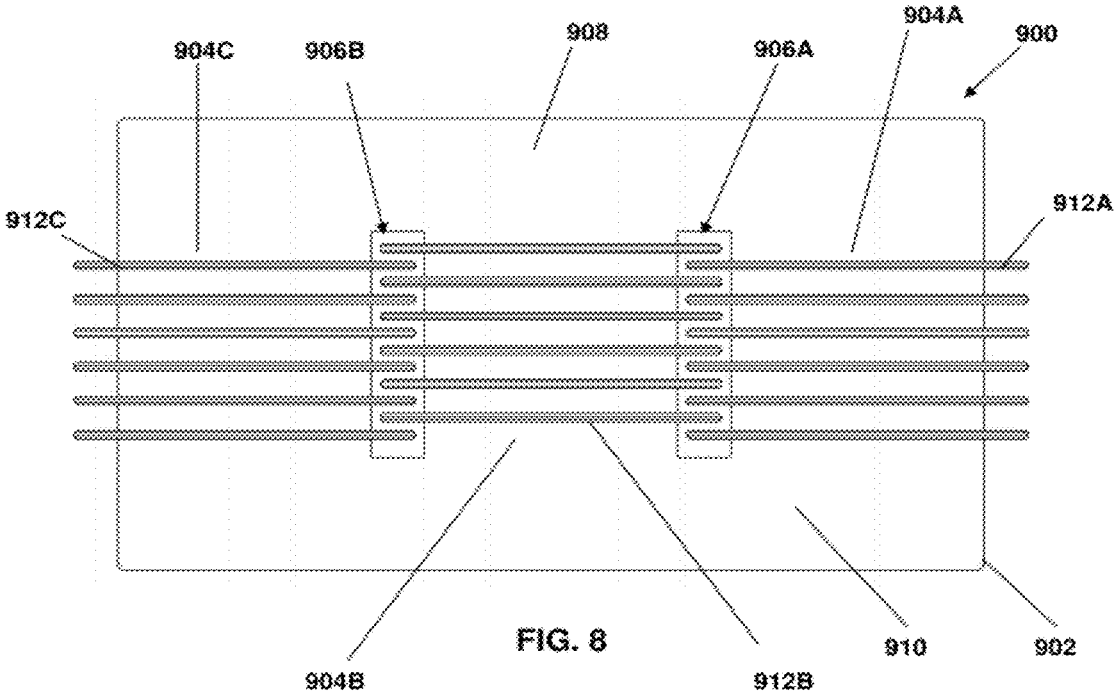
FIG. 8 is a front view of an example parallel multi-winding magnetic structure according to various aspects of this disclosure.
Figure 9:
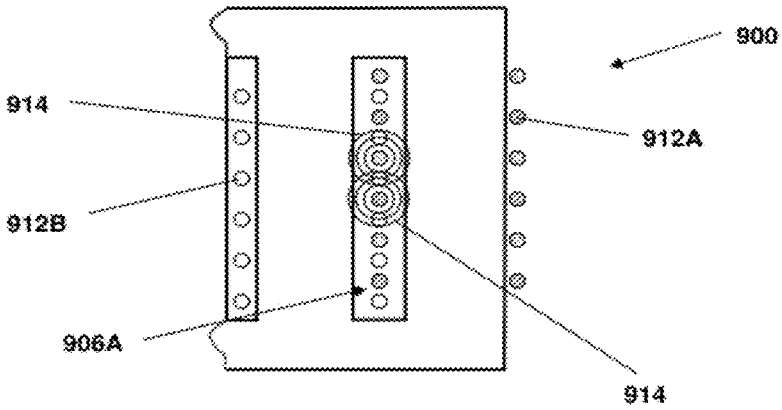
FIG. 9 is a cross sectional slice of a portion of the parallel multi-winding magnetic structure of FIG. 8.

In FIG. 8, a parallel multi-winding magnetic structure 900 includes a core 902 and windings 912A-C. The core includes columns 904A-C, a core top 908 and a core bottom 910. Opposing columns 904, the core top 908 and the core bottom 910 cooperatively define winding windows 906A, 906B. Each winding 912A-C is wound around a column and passes through at least one winding window 906. As can be seen, each winding 912 alternates, on a turn-by-turn basis, with another winding 912 in their shared winding window 906. FIG. 9 is a cross sectional view of a portion of the parallel multi-winding magnetic structure 900 showing the core 902 and the windings 912A and 912B within the window 906A. Two magnetic fields 914 that would be generated by current flowing through winding 912A are also illustrated in FIG. 9. As can be seen, the intercoil bifilar winding may help reduce the volume of space occupied by a magnetic field that couples to only one winding.

Figure 10:
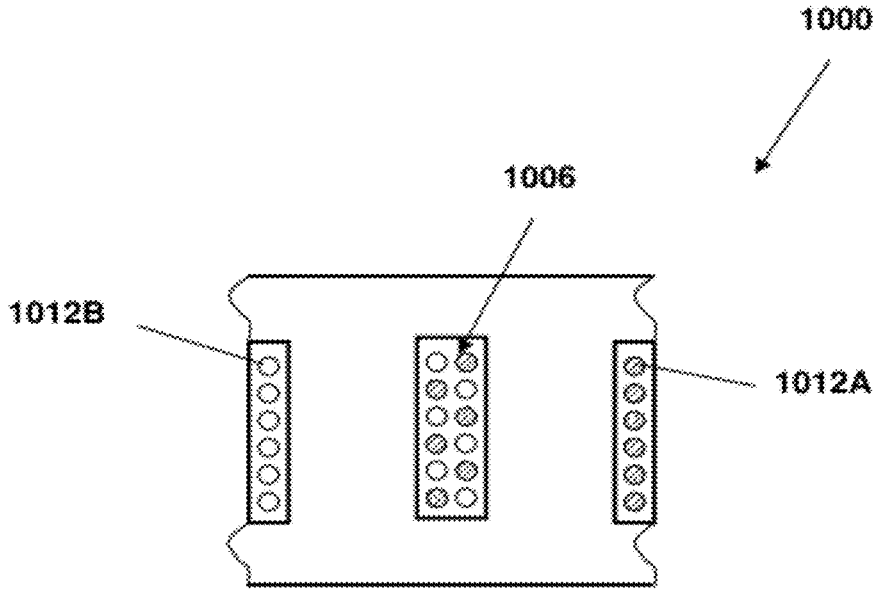
FIG. 10 is a cross sectional slice of a portion of an example parallel multi-winding magnetic structure illustrating windings according to this disclosure that are wound differently than the windings in the parallel multi-winding magnetic structure of FIG. 9.
Figure 11:
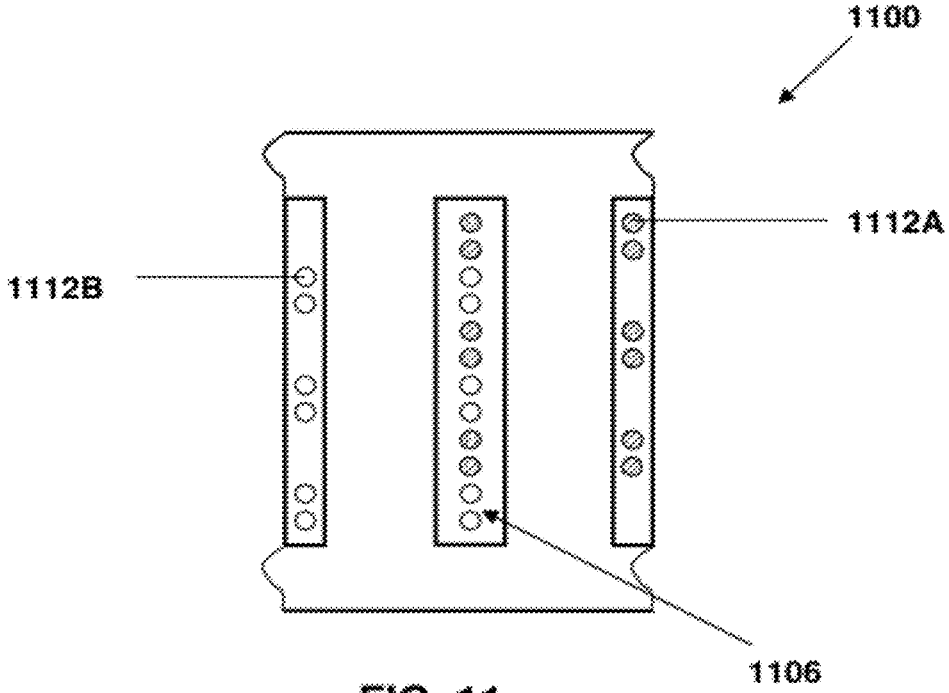
FIG. 11 is a cross sectional slice of a portion of an example parallel multi-winding magnetic structure illustrating windings according to this disclosure that are wound differently than the windings in the parallel multi-winding magnetic structure of FIGS. 9 and 10.

FIGS. 10 and 11 illustrate cross section portions of structures 1000, 1100 according to other example embodiments. The parallel multi-winding magnetic structures 1000, 1100 demonstrating some of the possible variations of the intercoil bifilar winding technique. In FIG. 10, the windings 1012A, 1012B of the parallel multi-winding magnetic structure 1000 alternate both from top to bottom of the winding window 1006, and also from side to side of the winding window 1006. The parallel multi-winding magnetic structure 1100 includes windings 1112A, 11128 that alternate from top to bottom of winding window 1106 in groups of two turns (instead of alternating on a turn-by-turn basis as occurs in the parallel multi-winding magnetic structure 1000 of FIGS. 8 and 9).

The example parallel multi-winding magnetic structures discussed above (e.g., 500, 600, 700, 900, 1000, 1100), have generally been illustrated and discussed with reference to three windings. However, the teachings disclosed herein (including those described above and below) may be used in parallel multi-winding magnetic structures having more than three windings. Some of the additional aspects of the present disclosure described hereinafter will be illustrated and/or discussed with reference to more than three windings. It should be understood that each of the aspects above and the aspects below may be utilized (individually or in any combination) for parallel multi-winding magnetic structures having any suitable number of windings.

According to still another aspect of the present disclosure, the volume of a parallel multi-winding magnetic structure occupied by the winding should be substantially minimized versus the volume of the core in the horizontal plane.

Figure 12A:
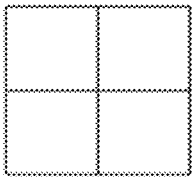
FIGS. 12A-12F are top plan view illustrations of various column configurations for cores of parallel multi-winding magnetic structures according to this disclosure.
Figure 12B:
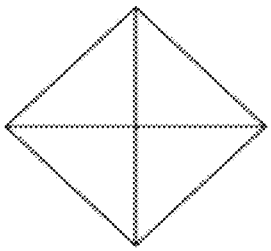
Figure 12C:
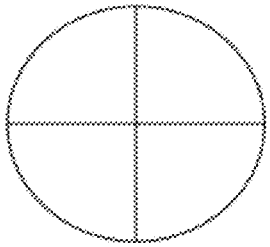
Figure 12D:
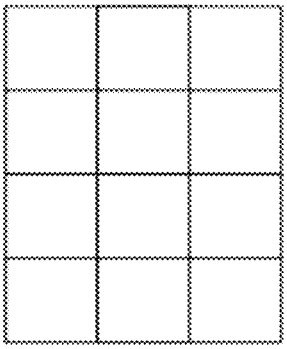
Figure 12E:
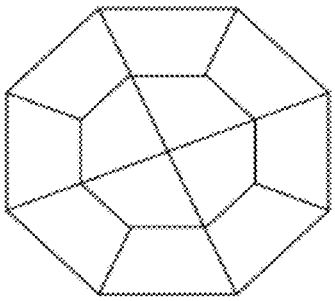
Figure 12F:
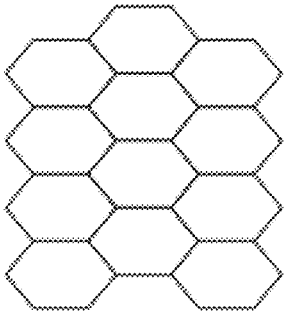

To achieve this, the overall area of the core in the horizontal plane may be divided between individual windings to maximize the ratio between the core area and the winding area. In other words, the length of the winding should be minimized for a given core area. This may be achieved if a linear arrangement (all windings in line, as shown for example in FIGS. 4-11) is replaced with a non-linear arrangement that places each winding in close proximity to all (or as many as possible) other windings. Several example embodiments illustrating configurations incorporating this aspect are illustrated in FIGS. 12A-12F. Each of FIGS. 12A-12C is a top plan view of a core (without a core top) for a four winding parallel multi-winding magnetic structures. In FIG. 12A, for example, the core is a square core having four square columns on which windings could be wound. Similarly, FIG. 12B is a square core with four triangular columns on which windings may be wound. FIG. 12C is a circular core having four pie-shaped columns. FIGS. 12D-12F illustrate example core configurations for twelve winding parallel multi-winding magnetic structures. Of course, more of fewer windings may be used in any particular application and other variations of configuration incorporating this aspect are within the scope of this disclosure. Other embodiments incorporating this aspect include the core 1202 of FIG. 13, the core 1402 of FIG. 15, and the core 1502 of FIG. 18.

In one example multi-winding magnetic structure incorporating this aspect, the structure includes a magnetic including a first column, a second column, and a third column. Each of the first, second and third columns has a center. The first and second columns are spaced apart from each other to define a first side and a second side of a first winding window between the first and second column. The third column is spaced from one of the first and second columns to define a first side and a second side of a second winding window between the third column and said one of the first and second columns. The first, second and third columns are positioned relative to each other such that a single straight line would not pass through the center of all three columns. The core includes a core top overlying the first, second and third columns and defining a top of the first and second winding windows. The core also includes a core bottom underlying the first, second and third columns and defining a bottom of the first and second winding windows. The multi-winding magnetic structure includes a first winding around the first column, a second winding around the second column, and a third winding around the third column.

According to yet another aspect, the magnetic field existing in top and bottom portions of the core of a parallel multi-winding magnetic structure should pass through the parts of the core inside the windings. The magnetic field in the space between the windings and outside the outline (e.g., the perimeter, outer edge, etc.) of the core should be substantially minimized. Example embodiments incorporating this aspect will be discussed with reference to FIGS. 13-17

To achieve this, the magnetic path reluctance on the outside perimeter of the core may be substantially maximized by not permitting the core top and core bottom to substantially overhang the outline of the core's winding columns. As a result, winding portions along the perimeter of the core (i.e., windings around the perimeter columns) are not covered by the core top and core bottom along the perimeter of the core. In one embodiment, the core top and core bottom overhang perimeter windings by less than half the width of a winding window through which the perimeter winding passes.

Figure 13:
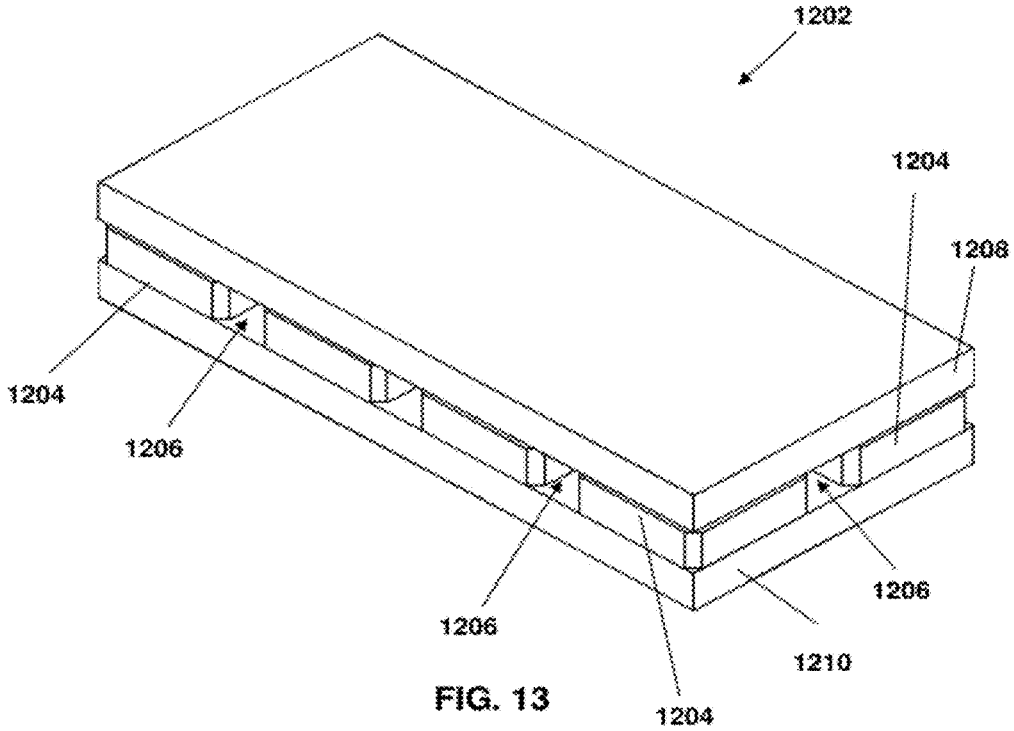
FIG. 13 is an isometric view of a core with eight columns for an example parallel multi-winding magnetic structure according to various aspects of this disclosure.
Figure 14:
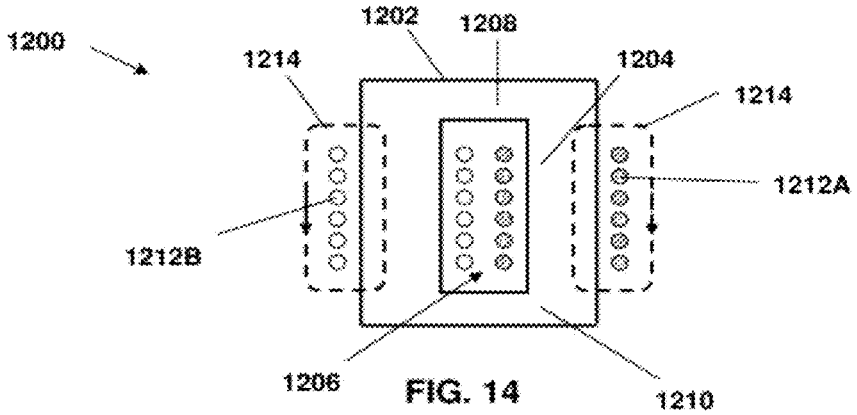
FIG. 14 is a cross sectional slice of a portion of a parallel multi-winding magnetic structure including the core of FIG. 15.

An example embodiment of a parallel multi-winding magnetic structure 1200 incorporating this aspect is illustrated in FIGS. 13 and 14. The parallel multi-winding magnetic structure 1200 includes a core 1202 having eight columns 1204 (five of which are visible in FIG. 13). The core includes the columns 1204, a core top 1208 and a core bottom 1210. Opposing columns 1204, the core top 1208 and the core bottom 1210 cooperatively define winding windows 1206. A winding 1212 is wound around each column 1204. To illustrate other features, the windings 1212 are not shown in FIG. 13. Two of the windings 1212A, 1212B are, however, illustrated in FIG. 14. Each winding 1212 is wound around a column 1204 and passes through at least one winding window 1206. In FIG. 14, it can be seen that the core top 1208 and core bottom 1210 do not overhang (or underhang) the windings 1212 at the perimeter of the parallel multi-winding magnetic structure 1200. Magnetic fields 1214 generated by current flowing through the windings 1212 are shown in FIG. 14. Because the core top 1208 and core bottom 1210 do not extend over/under the windings 1212, magnetic reluctance of the field path on the perimeter of the parallel multi-winding magnetic structure 1200 may be increased as compared to a core that does extend over/under its windings. This increased magnetic reluctance improves coupling between windings 1212 and reduce the leakage inductance of the structure 1200.

Figure 15:
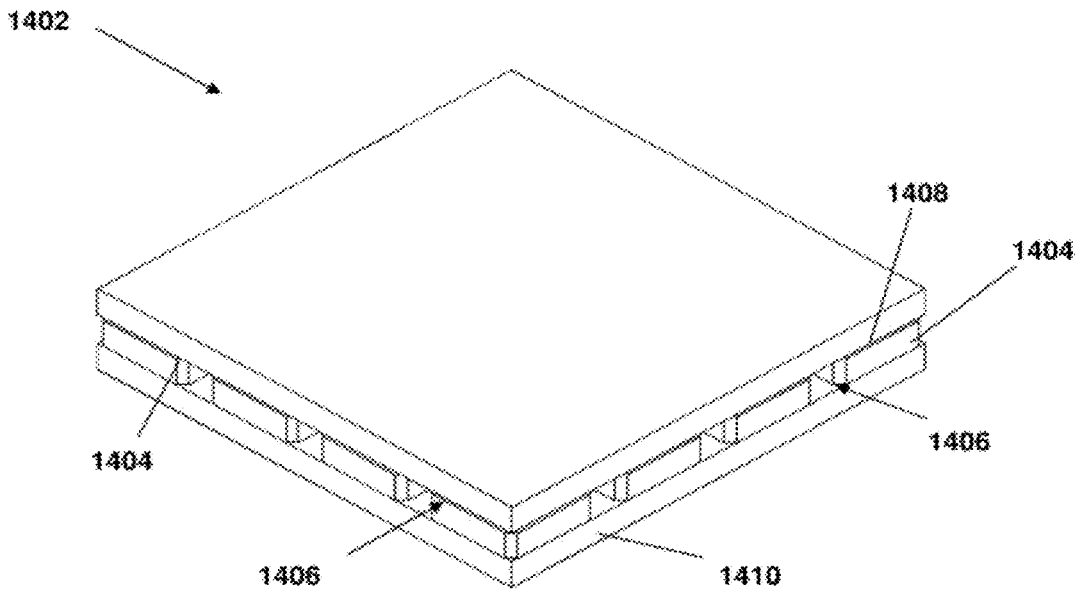
FIG. 15 is an isometric view of an example core with sixteen columns for a parallel multi-winding magnetic structure according to aspects of this disclosure.
Figure 16:
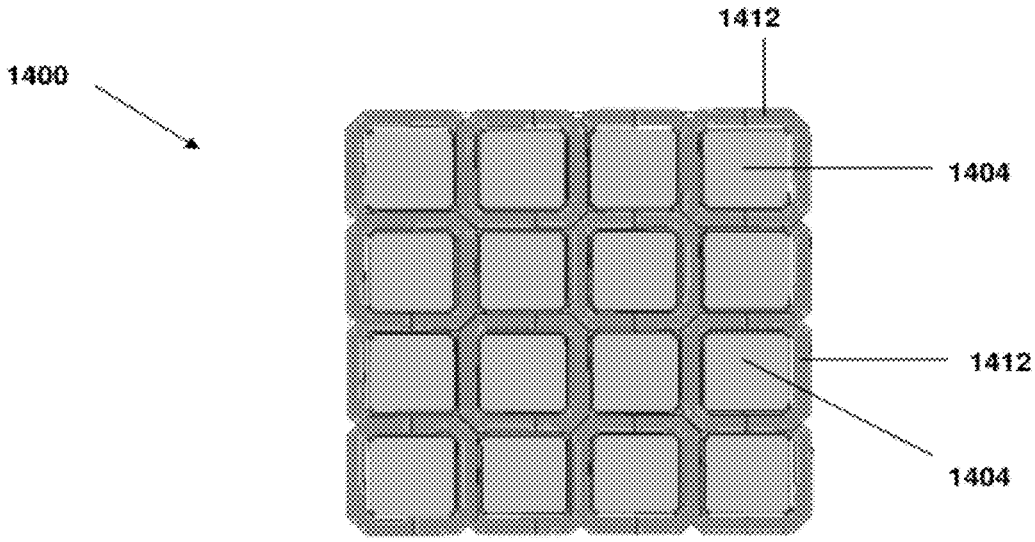
FIG. 16 is a top plan view of a parallel multi-winding magnetic structure including the core of FIG. 15 and sixteen windings with the core top removed.
Figure 17:
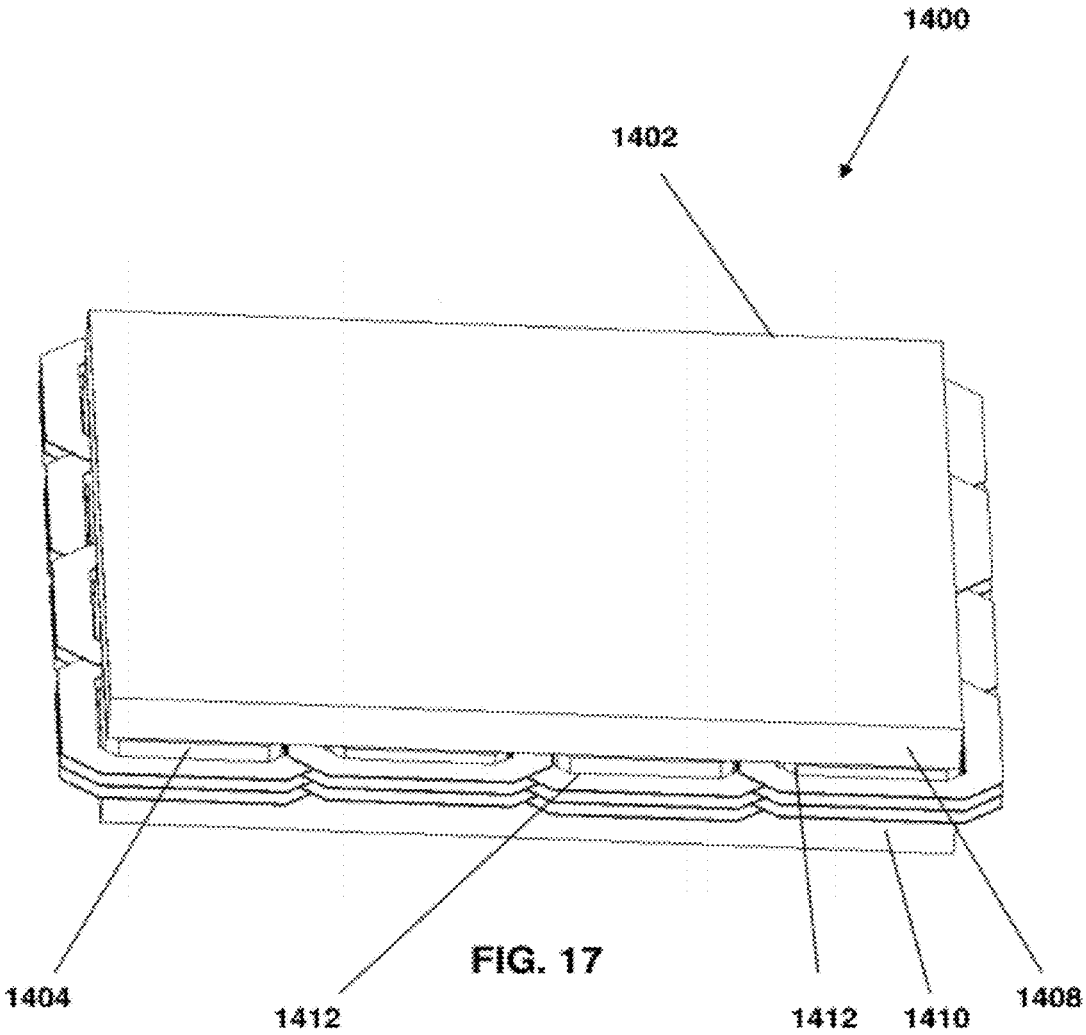
FIG. 17 is an isometric view of the parallel multi-winding magnetic structure of FIG. 16 with the core top in place.

Another example parallel multi-winding magnetic structure 1400 is shown in FIGS. 15-17. The parallel multi-winding magnetic structure 1400 includes a core 1402 having sixteen columns 1404 (seven of which are visible in FIG. 15). The core includes the columns 1404, a core top 1408 and a core bottom 1410. Opposing columns 1404, the core top 1408 and the core bottom 1410 cooperatively define winding windows 1406. A winding 1412 is wound around each column 1404. The windings 1412 are not illustrated in FIG. 15. Each winding 1412 is wound around a column 1404 and passes through at least one winding window 1406. In FIG. 17, it can be seen that the core top 1408 and core bottom 1410 do not overhang the windings 1412 at the perimeter of the parallel multi-winding magnetic structure 1400.

The core top and/or core bottom of a parallel multi-winding magnetic structure may, additionally or alternatively, have their edges chamfered to help minimize the magnetic field in the space outside the core.

Figure 18:
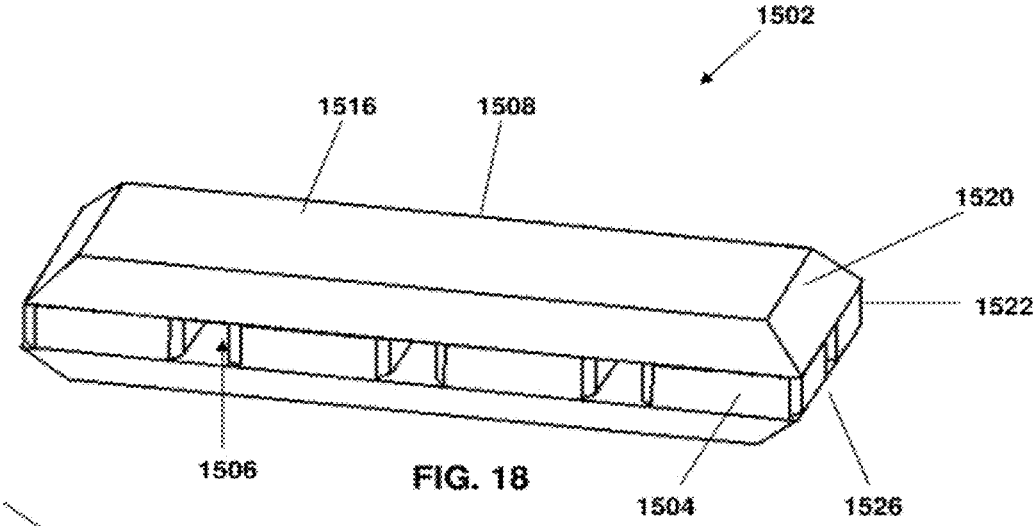
FIG. 18 is an isometric view of an example core with eight columns and a chamfered top and bottom for use in a parallel multi-winding magnetic structure according to aspects of this disclosure.
Figure 19:
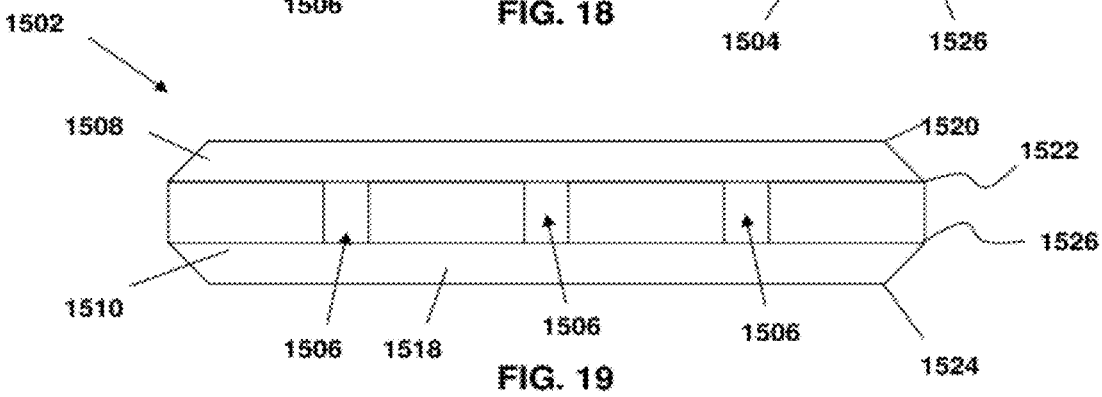
FIG. 19 is a side plan view of the example core of FIG. 18.
Figure 20:
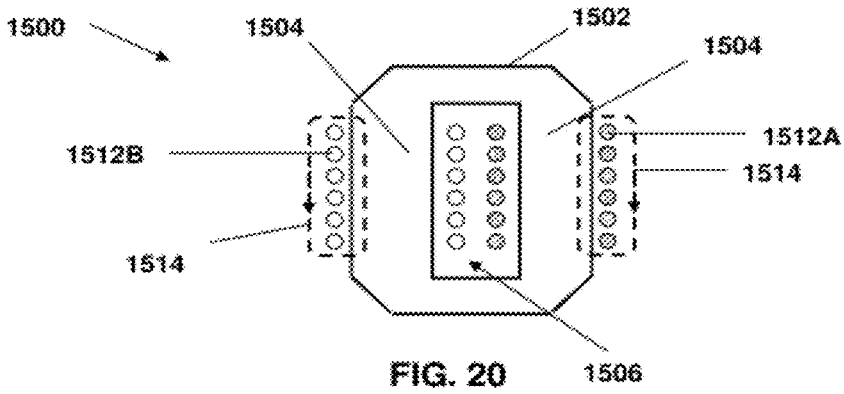
FIG. 20 is a cross sectional slice of a portion of a parallel multi-winding magnetic structure including the core of FIG. 18.

An example embodiment of a parallel multi-winding magnetic structure 1500 including a chamfered core top and a chamfered core bottom is illustrated in FIGS. 18-20. The parallel multi-winding magnetic structure 1500 includes a core 1502 having eight columns 1504. The core includes the columns 1504, a core top 1508 and a core bottom 1510. Opposing columns 1504, the core top 1508 and the core bottom 1510 cooperatively define winding windows 1506. A winding 1512 is wound around each column 1504. The windings 1512 are not illustrated in FIGS. 18 and 19. Two windings 1512A, 1512B are illustrated in FIG. 20. Each winding 1512 is wound around a column 1522 and passes through at least one winding window 1506.

The core top 1508 has a central section 1516 with a substantially constant thickness. The thickness of the central section 1516 generally defines the thickness of the core top 1508. The thickness of the core top 1508 decreases from a perimeter 1520 of the central section 1516 to an exterior edge 1522 of the core top 1508.

The core bottom 1510 has a central section 1518 with a substantially constant thickness. The thickness of the central section 1518 generally defines the thickness of the core bottom 1510. The thickness and chamfer of the core bottom 1510 may be the same as or different from the core top 1508. The thickness of the core bottom 1510 decreases from a perimeter 1524 of the central section 1518 to an exterior edge 1526 of the core bottom 1510.

Magnetic fields 1514 generated by current flowing through the windings 1512 are illustrated in FIG. 20. As compared with other structures, the volume of the uncoupled magnetic field 1514 of the parallel multi-winding magnetic structure 1500 is reduced because the chamfering of the core top 1508 and core bottom 1510. The increased magnetic reluctance of the field path on the perimeter of the parallel multi- winding magnetic structure 1500 may improve coupling between the windings 1512 and reduce the leakage inductance of the parallel multi-winding magnetic structure 1500.

The core top and the core bottom may be chamfered at the same angle or at different angles. The angle at which the core top and the core bottom are chamfered may be any suitable angle. In some embodiments, the angle of the chamfer is at least fifteen degrees and less than about seventy-five degrees. The angle may be the same on all sides of a core top and/or core bottom. Alternatively one or more of the sides of a core top or core bottom may be chamfered at an angle different from one or more other sides. Although illustrated in the figures as a straight chamfer that decreases the thickness of the core top/bottom in a linear fashion, core top and core bottom may be chamfered in different profiles (e.g., a convex chamfer, etc.).

The core (e.g., 402, 502, 602, 702, 902, 1202, 1402, 1502) for any of parallel multi-winding magnetic structures disclosed herein may be made of any suitable magnetic material or materials including, for example, ferrite, iron powder, amorphous metal, laminated steel, laminated iron, carbonyl iron, soft iron, etc. The core may be monolithically formed (i.e., the core top, core bottom and columns may be a single piece of material) or the core may be constructed from two or more separate parts, layers, materials, etc. The magnetic material may be a single magnetic material, a composite material, etc.

Windings for any of the parallel multi-winding magnetic structures disclosed herein (e.g., 500, 600, 700, 900, 1000, 1100, 1200, 1400, 1500) may be made of any suitable materials. For example, the windings may be made from metal wire or from metal sheets (by, for example, cutting, stamping, etc.). The metal of the wire or sheets may be any suitable metal or combination of metals including, for example, copper. The windings may also be formed as traces on a printed circuit board or a flexible circuit. To produce more than one turn in a winding on a PCB, multiple layers may be used with conductive vias appropriately connecting traces on adjacent layers.

Also for all parallel multi-winding magnetic structures disclosed herein (e.g., 500, 600, 700, 900, 1000, 1100, 1200, 1400, 1500), the areas of individual windings may be the same or different. The number of turns of the individual windings may be the same or may be different. Individual windings may connect to separate circuits or be connected to each other in various combinations.

In embodiments including columns that are not located along the perimeter of the structure's core (e.g. parallel multi-winding magnetic structure 1400 in FIGS. 15-17), input/output connections to windings around the interior columns may be made via holes in the core top, the core bottom, or both.

The parallel multi-winding magnetic structures described herein (e.g., 500, 600, 700, 900, 1000, 1100, 1200, 1400, 1500) may be used for isolated and non-isolated applications. They may also be used for applications mainly concerned with transforming energy (e.g., transformers), energy storage (e.g., inductors), or both. The may also be designed to work with significant DC bias (e.g., to operate as chokes). The parallel multi-winding magnetic structures may contain a gap in the magnetic path or the gap may be omitted.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A multi-winding magnetic structure comprising:

a magnetic core, the core including a core top having an exterior edge, a central section of the core top having a substantially constant thickness and a perimeter;

a core bottom beneath the core top, the core bottom having an exterior edge, a central section of the core bottom having a substantially constant thickness and a perimeter, the thickness of one of the core bottom and the core top decreasing from the perimeter of its central section to its exterior edge to increase a magnetic reluctance of a field path on a perimeter of the multi-winding magnetic structure;

at least four columns extending between the core bottom and the core top; and at least four windings, a different one of the at least four windings wound around each of the at least four columns.

2. The multi-winding magnetic structure of claim 1 wherein the thickness of the core bottom decreases from the perimeter of its central section to the exterior edge of the core bottom and the thickness of the core top decreases from the perimeter of its central section to the exterior edge of the core top.

3. The multi-winding magnetic structure of claim 2 wherein the central portion of the core top is greater than about 50% of the area of the core top and the central portion of the core bottom is greater than about 50% of the area of the core bottom.

4. The multi-winding magnetic structure of claim 2 wherein the decrease in the thickness of the core top and the core bottom is a linear decrease in thickness.

5. The multi-winding magnetic structure of claim 2 wherein the core top and the core bottom do not extend beyond an edge of any column located along the exterior edge of the core top and the core bottom.

6. The multi-winding magnetic structure of claim 2 wherein the core top, the core bottom, and the at least four columns are all constructed of the same type of magnetic material.

7. The multi-winding magnetic structure of claim 6 wherein the core top, the core bottom, and the at least four columns are monolithically formed.

8. The multi-winding magnetic structure of claim 2 wherein the at least four windings are traces on a printed circuit board.

9. A power converter including the multi-winding magnetic structure of claim 2.

10. A multi-winding magnetic structure comprising:

a magnetic core including a first column, a second column, a third column, a winding window between the first and second columns, the winding window having a width defined by the first and second columns, a first ratio of the width of the first column to the width of the winding window is at least two and a second ratio of the width of the second column to the width of the winding window is at least two, a first winding around the first column passing through the winding window; a second winding around the second column and passing through the winding window; and a third winding around the third column.

11. The multi-winding magnetic structure of claim 10 wherein the first ratio and the second ratio are substantially the same.

12. The multi-winding magnetic structure of claim 10 wherein the first ratio and the second ratio are each at least three.

13. The multi-winding magnetic structure of claim 10 wherein the first ratio and the second ratio are each at least four.

14. The multi-winding magnetic structure of claim 10 wherein the magnetic core includes a core top overlying the first, second and third columns and a core bottom underlying the first, second and third columns, the winding window has a height defined by the core top and the core bottom, and wherein portions of the first winding and the second winding passing through the winding window cooperatively occupy substantially all of the height and substantially all of the width of the winding window.

15. The multi-winding magnetic structure of claim 10 wherein the core top, the core bottom, the first column, the second column and the third column are all constructed of the same type of magnetic material.

16. The multi-winding magnetic structure of claim 14 wherein the core top, the core bottom, the first column, the second column and the third column are monolithically formed.

17. The multi-winding magnetic structure of claim 10 wherein the first, second and third windings are traces on a printed circuit board.

18. A power converter including the multi-winding magnetic structure of claim 10.

19. The multi-winding magnetic structure of claim 1, wherein the multi-winding magnetic structure includes eight columns extending between the core bottom and the core top.

20. The multi-winding magnetic structure of claim 1, wherein the multi-winding magnetic structure includes twelve columns extending between the core bottom and the core top.

21. The multi-winding magnetic structure of claim 1, wherein the multi-winding magnetic structure includes sixteen columns extending between the core bottom and the core top.

* * * * *